US006478640B2

(12) United States Patent
Raps

(10) Patent No.: US 6,478,640 B2
(45) Date of Patent: Nov. 12, 2002

(54) PROPELLER SAFETY GUARD FOR OUTBOARD AND STERN DRIVE MOTORS

(76) Inventor: Gerard P. Raps, 16886 - 21St. Avenue, Surrey, B.C. (CA), V4P 2T4

( * ) Notice: Subject to any disclaimer, the term of this patent is extended or adjusted under 35 U.S.C. 154(b) by 0 days.

(21) Appl. No.: 09/795,213

(22) Filed: Mar. 1, 2001

(65) Prior Publication Data

US 2001/0036776 A1 Nov. 1, 2001

(51) Int. Cl.[7] ..... B63H 5/16
(52) U.S. Cl. ..... 440/72
(58) Field of Search ..... 440/71, 72

(56) References Cited

U.S. PATENT DOCUMENTS 5,759,075 A * 6/1998 Steep et al. ..... 440/72

6,162,104 A * 12/2000 White ..... 440/71

* cited by examiner

*Primary Examiner*—Jesus D. Sotelo
(74) *Attorney, Agent, or Firm*—Robert B. Hughes; Hughes Law Firm PL

(57) ABSTRACT

The Propeller Safety Guard is a wire mesh type enclosure covering the perimeter of the propeller as well as the rear plan of the propeller. The upper section of the guard is bolted to the underside of the outboard motor anticavitation plate. The lower section of the guard is bolted to the skeg of the outboard motor by a connection mounting bracket which has along gated holes to allow for adjust ability in order to locate the ideal position on the motor skeg for mounting the guard. This guard encloses the propeller from the two most dangerous exposures, the propeller tips rotating and the rear of the propeller. The forward section of the propeller is to some extent protected by the lower leg of the outboard motor.

6 Claims, 1 Drawing Sheet

PROPELLER SAFETY GUARD FOR OUTBOARD AND STERN DRIVE MOTORS

BACKGROUND OF THE INVENTION

Protecting humans from the turning propeller blades has been a concern ever since the outboard motor was invented for use especially on pleasure boats. Many different designs of guards have been patented in the past. All of these designs are cumbersome guards, inhibit performance greatly, in many cases are custom designed to fit the many different configurations of outboard motors and stern drives. Therefore they are expensive to manufacture and costly to the consumer. It appears that for these reasons none of the earlier inventions ever provided the consumer with a satisfactory product. Therefore a propeller guard that provides reasonable protection, inhibits performance the least amount possible, is easily installed and affordable, would be a major improvement to prior art.

BRIEF DESCRIPTION OF THE INVENTION

The Propeller Safety Guard of the described invention presents a new approach to avoiding propeller related injuries caused by marine type of propellers on small and medium size outboard motors and stern drives. The Guard is installed on the lower leg of outboard motors and stern drives for protection to swimmers, diver, water skiers and marine life that may come in contact with turning propellers while the motor is running.

The economical method to manufacture the described invention, the adaptability to all major outboard motor/propellers on the market today and the adjustable mounting bracket feature would be a major advantage over prior art in the field.

Figures 1, 2:
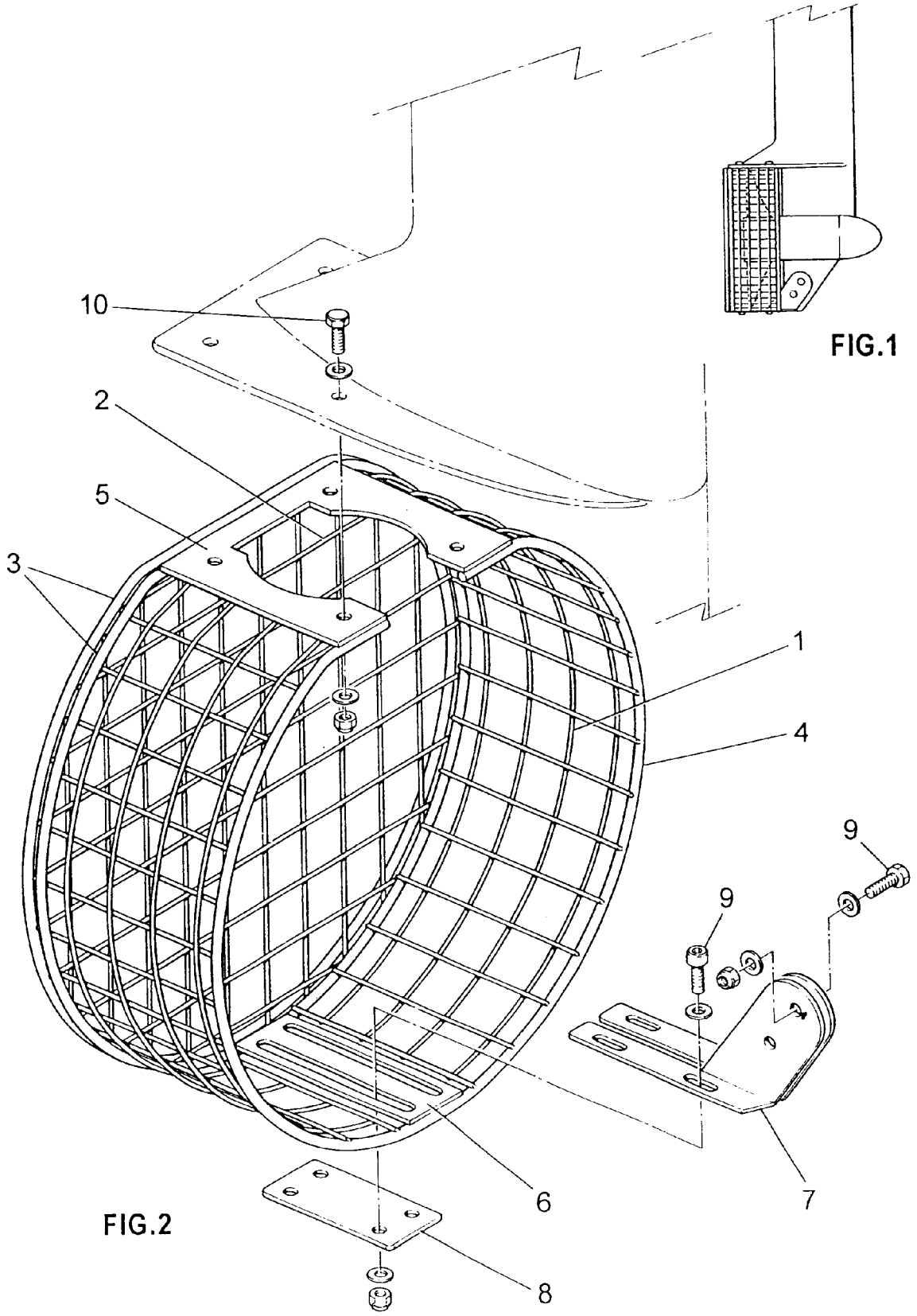
FIG. 1, Illustrates a side view of the complete guard mounted to the lower leg of an outboard motor.
FIG. 2, is a three dimensional view of the described invention showing the Safety Guard, upper and lower mounting brackets and how the guard is fastened to the leg of an outboard motor.

No 1. Illustrates the circular shape of the wire mesh protective guard.

No 2. Illustrates the rear flat shape of the wire mesh protective guard

No 3. Illustrates the 2 circular rings with No. 2 between both rings and No 1 attached to the inner of circular ring.

No 4. Illustrates the leading edge circular ring attached to No 1.

No 5. Illustrates the upper mounting plate of the guard welded to the inner circular ring No 3, the leading edge circular ring No. 4 and the wire mesh circular shape No 1.

No 6. Illustrates the lower mounting slide plate welded to the inner circular ring No 3 and leading circular ring No 4.

No 7. Illustrates the lower mounting bracket (2) one left side and one right side.

No 8. Illustrates the re-enforcement plate installed below No 6 lower mounting slide.

No 9. Illustrates the fasteners, bolt, nut and washer to attach the lower mounting bracket to guard and skeg of motor.

No 10. Illustrates the bolt, nut and washer to attach to the upper mounting plate No 5 below the anti-cavitation plate of the motor.

The described invention is further articulated in the attached detailed description of the invention.

DETAILED DESCRIPTION OF THE INVENTION

Referring to more detail of the invention it is noted that the propeller safety guard described in the drawings is in every instance mounted to the lower leg of a conventional outboard motor or stem drive unit. More specifically the guards upper mounting plates are mounted below the anti cavitation plate of the motor and the guards lower mounting bracket is mounted to the skeg of the lower leg. Therefore the guard is enclosing the two most vulnerable exposed surfaces of the rotating propeller.

FIG. 2. The propeller safety guard described in this invention consists in general of a cage like wire mesh enclosure No 1 and No 2 supported structurally by two circular rings, No 3, at the rear of the guard and one circular ring, No 4 at the front of the guard. Said circular rings are welded to the circulator wire mesh, No 1 and welded to the flat wire mesh, No 2. The upper mounting plate, No 5 is welded to the circular wire mesh, No 1, with a 2" wide open center section to allow proper positioning over the propeller. The upper mounting plate has a radiused cut out to allow clearance for a anode mounted in lower surface of anti cavitation plate. Additionally the upper mounting plate, No 5 four holes to allow for mounting guard below anti cavitation plate.

No 7 describes the two lower L-shaped mounting brackets. Each mounting bracket has on the radius portion two holes, if when mounting on the skeg of the lower leg, line up perfectly with each other. Elongated holes allow for adjustment in unison with adjustable slide plate, No 6. The rectangular section of described lower mounting bracket, No 7 are bent 90 degree in relation to radiused portion of each mounting bracket. The adjustable slide plate, No 6 is welded on the lower inside of No 3 and 4 circular rings and elongated holes allow adjust ability with L shaped mounting brackets, No 7. The re-enforcement plate, No 8, is located below the adjustable slide plate, No 6. This re-enforcement plate is a rectangular plate with four holes matching the adjustable slide plate, No 6 and the two lower mounting brackets, No 7, locked into position with fasteners, No 9. Bolt lock nut and flat washer No. 10, total of four each, fasten the Safety Guard to the underside of anti-cavitation plate of motor.

FIG. 1 illustrates a complete side view assembly of the described invention onto a lower leg of an outboard motor.

What I claim is:

1. A propeller safety guard for a boat having a motor, a propeller, and a plate-like member above the propeller, said apparatus comprising:

a) a guard member extending around a substantial portion of an outer perimete of said propeller, said guard member having an upper mounting section adapted to be connected to said plate-like member and a lower mounting section at a lower central portion of said guard member;

b) a mounting bracket adapted to be connected to said lower mounting section with said mounting bracket and said lower mounting section having a slot/connector arrangement to interconnect the mounting bracket to the lower mounting section in the manner to permit forward to rear adjustment of the relative locations of the mounting bracket and the lower mounting section.

2. The guard as recited in claim 1, wherein the guard member is a circular wire mesh guard.

3. The guard as recited in claim 1, wherein said upper mounting section is fixedly attached to the guard member and has an open center section shaped to allow mounting to an under side of the plate-like member.

4. The guard as recited in claim 1, wherein said mounting bracket comprises two mounting bracket portions each of which is attached to a skag of the motor on opposite sides thereof.

5. The guard as recited in claim 4, wherein said bracket has forwardly and upwardly extending connecting portion to connect to the skag.

6. The guard as recited in claim 5, wherein said mounting bracket positions are generally symmetrical.

* * * * *